US011189232B2

(12) United States Patent
Lee et al.

(10) Patent No.: US 11,189,232 B2
(45) Date of Patent: Nov. 30, 2021

(54) ORGANIC LIGHT EMITTING DISPLAY DEVICE AND DRIVING METHOD THEREOF

(71) Applicant: LG Display Co., Ltd., Seoul (KR)

(72) Inventors: Cheolsu Lee, Paju-si (KR); BongSik Park, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/121,225

(22) Filed: Dec. 14, 2020

(65) Prior Publication Data

US 2021/0201797 A1 Jul. 1, 2021

(30) Foreign Application Priority Data

Dec. 26, 2019 (KR) ..... 10-2019-0175419

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0819* (2013.01); *G09G 2310/08* (2013.01); *G09G 2320/029* (2013.01); *G09G 2320/0295* (2013.01); *G09G 2320/045* (2013.01); *G09G 2330/12* (2013.01)

(58) Field of Classification Search
CPC ..... G09G 3/3258; G09G 3/3233; G09G 2300/0819; G09G 2310/08; G09G 2320/029; G09G 2320/0233; G09G 2320/0295; G09G 2320/043; G09G 2320/045; G09G 2330/12
USPC ..... 345/214
See application file for complete search history.

(56) References Cited

U.S. PATENT DOCUMENTS 9,607,549 B2 3/2017 Tani et al.
2013/0050292 A1* 2/2013 Mizukoshi ..... G09G 3/3291 345/690
2015/0187276 A1* 7/2015 Shim ..... G09G 3/3291 345/77
2015/0294626 A1* 10/2015 Bi ..... G09G 3/3233 345/211
2015/0325174 A1* 11/2015 Yu ..... H01L 27/32 345/77
2016/0189614 A1* 6/2016 Tani ..... H01L 27/3265 345/211

(Continued)

FOREIGN PATENT DOCUMENTS

KR 10-2016-0078867 A 7/2016
KR 10-2017-0080337 A 7/2017

*Primary Examiner* — Tom V Sheng
(74) *Attorney, Agent, or Firm* — Fenwick & West LLP

(57) ABSTRACT

An organic light emitting display device and a driving method thereof are disclosed, wherein the organic light emitting display device comprises a display panel provided with pixels connected to a sensing line; and a sensing unit outputting a sensing voltage of the pixel, which is input through the sensing line, as sensing data in a first sensing mode performed during power-off and a second sensing mode performed in the middle of driving a display mode, wherein the display panel includes a first capacitor connected to the sensing line to store a sensing voltage of the first sensing mode and provide the sensing voltage to the sensing unit, and a second capacitor connected to the sensing line to store a sensing voltage of the second sensing mode and provide the sensing voltage to the sensing unit.

13 Claims, 11 Drawing Sheets

(56) References Cited

U.S. PATENT DOCUMENTS

| | | | | |
|---|---|---|---|---|
| 2016/0189625 | A1* | 6/2016 | Kim | G09G 3/3233 345/205 |
| 2016/0247450 | A1* | 8/2016 | Liu | G09G 3/3258 |
| 2017/0061892 | A1* | 3/2017 | Jung | G09G 3/3291 |
| 2018/0114815 | A1* | 4/2018 | Lee | H01L 51/50 |
| 2018/0308430 | A1* | 10/2018 | Xu | G09G 3/3233 |
| 2019/0172394 | A1* | 6/2019 | Wang | G09G 3/3258 |
| 2020/0020277 | A1* | 1/2020 | Lee | H01L 51/5206 |
| 2020/0135094 | A1* | 4/2020 | Chen | G09G 3/3241 |
| 2020/0184902 | A1* | 6/2020 | Kim | G09G 3/3233 |
| 2020/0388218 | A1* | 12/2020 | Han | G09G 3/3233 |
| 2021/0028265 | A1* | 1/2021 | Kim | G09G 3/3266 |
| 2021/0035501 | A1* | 2/2021 | Feng | G09G 3/3258 |
| 2021/0049968 | A1* | 2/2021 | Yuan | G09G 3/3233 |
| 2021/0210006 | A1* | 7/2021 | Song | G09G 3/3233 |
| 2021/0225277 | A1* | 7/2021 | Xu | G09G 3/3291 |

* cited by examiner

ORGANIC LIGHT EMITTING DISPLAY DEVICE AND DRIVING METHOD THEREOF

CROSS-REFERENCE TO RELATED APPLICATIONS

This application claims priority to Republic of Korea Patent Application No. 10-2019-0175419, filed on Dec. 26, 2019, which is hereby incorporated by reference in its entirety.

BACKGROUND

Technical Field

The present disclosure relates to an organic light emitting display device and a driving method thereof.

Description of the Related Art

An organic light emitting display device arranges subpixels, each of which includes an organic light emitting diode (hereinafter, referred to as "light emitting diode"), in the form of matrix, and controls luminance of the subpixels in accordance with a gray scale of image data to display images. The subpixels include a light emitting diode and a driving thin film transistor (TFT) controlling a driving current input to the light emitting diode.

The driving TFT has degradation characteristic in which a threshold voltage is changed by the elapse of a driving time. If the threshold voltage is changed, a problem occurs in that picture quality is degraded due to a deviation of current flowing in the organic light emitting diode (OLED) even though the same data voltage Vdata is applied thereto. To solve this problem, various compensation methods are known, which perform real-time sensing in the middle of sensing characteristic of the driving TFT or driving of the driving TFT when a display device is turned on/off.

However, real-time sensing is performed for a blank period to minimize an influence on an image which is being displayed. Therefore, a problem occurs in that there is limitation in data capable of being obtained during real-time sensing.

BRIEF SUMMARY

The present disclosure has been made in view of the above problems, and it is an object of the present disclosure to provide an organic light emitting display device and a driving method thereof, which may compensate for a threshold voltage of a driving TFT by sensing the threshold voltage of the driving TFT during real-time sensing.

In addition to the objects of the present disclosure as mentioned above, additional objects and features of the present disclosure will be clearly understood by those skilled in the art from the following description of the present disclosure.

In accordance with an aspect of the present disclosure, the above and other objects can be accomplished by the provision of an organic light emitting display device comprising a display panel provided with pixels connected to a sensing line; and a sensing unit outputting a sensing voltage of the pixel, which is input through the sensing line, as sensing data in a first sensing mode performed during power-off and a second sensing mode performed in the middle of driving a display mode, wherein the display panel includes a first capacitor connected to the sensing line to store a sensing voltage of the first sensing mode and provide the sensing voltage to the sensing unit, and a second capacitor connected to the sensing line to store a sensing voltage of the second sensing mode and provide the sensing voltage to the sensing unit.

The second capacitor may have a capacity smaller than that of the first capacitor.

The organic light emitting display device may further comprise a first switch connecting the first capacitor with the sensing line in accordance with a first sensing mode selection signal, and a second switch connecting the second capacitor with the sensing line in accordance with a second sensing mode selection signal.

The sensing unit may include a fourth switch connecting the sensing line with a first reference voltage source, a third switch connecting the sensing line with a second reference voltage source, and a fifth switch connecting the sensing line with an analog-to-digital converter to sample the sensing voltage.

The organic light emitting display device may further comprise a voltage supply unit supplying data for the first sensing mode to the pixel in the first sensing mode and supplying data for the second sensing mode for a blank period between active periods based on a vertical synchronization signal in the second sensing mode.

The voltage supply unit may supply image data for image display for the active period.

The pixel may include a driving TFT and an OLED of which amount for light emission is controlled in accordance with the driving TFT, and the sensing voltage may be a threshold voltage of the driving TFT.

The organic light emitting display device may further comprise a timing controller outputting the first sensing mode selection signal during the power-off, outputting the second sensing mode selection signal in the middle of driving the display mode to receive the sensing data from the sensing unit, and compensating for image data displayed in the middle of driving the display mode based on the sensing data.

The timing controller may output the second sensing mode selection signal for the blank period between the active periods based on the vertical synchronization signal.

In accordance with another aspect of the present disclosure, the above and other objects can be accomplished by the provision of a driving method of an organic light emitting display device, which comprises receiving sensing data of a pixel connected to a sensing line through a first capacitor driven in a first sensing mode during power-off and connected to the sensing line, supplying image data for image display to the pixel for an active period based on a vertical synchronization signal in the middle of driving a display mode, and receiving the sensing data of the pixel connected to the sensing line through a second capacitor driven in a second sensing mode for the blank period between the active periods and connected to the sensing line.

The second capacitor may have a capacity smaller than that of the first capacitor.

The pixel may include a driving TFT and an OLED of which amount for light emission is controlled in accordance with the driving TFT, and the sensing voltage may be a threshold voltage of the driving TFT.

The driving method may further comprise compensating for the image data based on the sensing data.

In the organic light emitting display device and the driving method thereof according to the present disclosure, a small scaled capacitor applicable to the sensing line during real-time sensing may additionally be provided, whereby the threshold voltage of the driving TFT may be sensed even for a blank period between frames. As a result, the threshold voltage of the driving TFT may be sensed in real time and compensated.

Also, in the organic light emitting display device and the driving method thereof according to the present disclosure, a driving state is maintained for a long time without power-off, and the threshold voltage of the driving TFT may be sensed to compensate for the changed threshold voltage with respect to an organic light emitting display device in which the same frame is repeatedly scanned, for example, a display device used for an electric sign board or a bulletin board.

In addition to the effects of the present disclosure as mentioned above, additional objects and features of the present disclosure will be clearly understood by those skilled in the art from the following description of the present disclosure.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Figure 1:
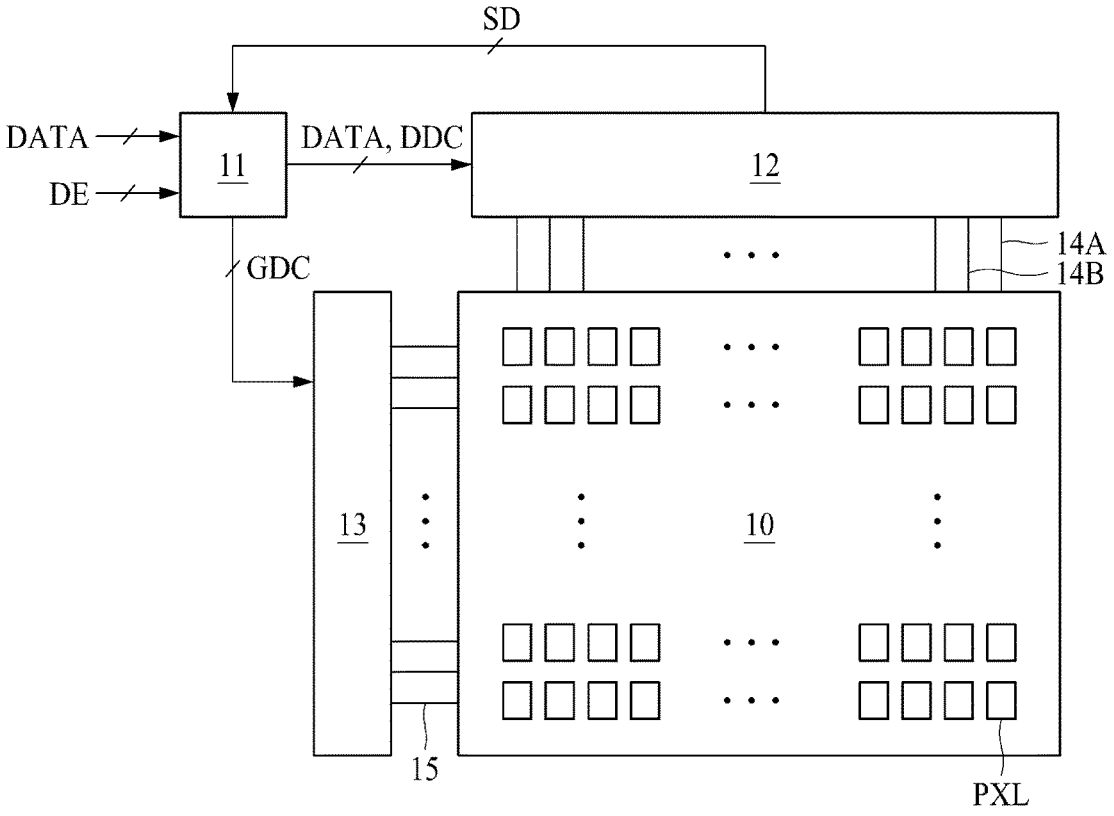
FIG. 1 is a schematic block view illustrating a display device having a current sensing function according to an embodiment of the present disclosure.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout the specification. In the following description, when the detailed description of the relevant known function or configuration is determined to unnecessarily obscure the important point of the present disclosure, the detailed description will be omitted. In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when the position relationship is described as 'upon~', 'above', 'below~', and 'next to~', one or more portions may be arranged between two other portions unless 'just' or 'direct' is used.

It will be understood that, although the terms "first", "second", etc. may be used herein to describe various elements, these elements should not be limited by these terms. These terms are only used to partition one element from another. For example, a first element could be termed a second element, and, similarly, a second element could be termed a first element, without departing from the scope of the present invention.

The same reference numbers will be used throughout the drawings to refer to the same or like parts.

Hereinafter, the embodiment of the present disclosure will be described in detail with reference to the accompanying drawings. In the following description of the present disclosure, if detailed description of elements or functions known in respect of the present disclosure is determined to make the subject matter of the present disclosure unnecessarily obscure, the detailed description will be omitted.

FIG. 1 is a schematic block view illustrating a display device having a current sensing function according to an embodiment of the present disclosure.

Referring to FIG. 1, the display device includes a display panel 10 provided with a plurality of pixels, a scan driver 13, a data driver 12, and a timing controller 11. The display device may operate in a display mode for image display and a sensing mode for sensing electric characteristic.

A plurality of data lines 14A, a plurality of sensing lines 14B and a plurality of scan lines 15 are arranged in the display panel 10. Pixels PXL are arranged in areas where the plurality of data lines 14A, the plurality of sensing lines 14B and the plurality of scan lines 15 are cross one another. Each pixel PXL includes a light emitting diode (hereinafter, referred to as OLED), and a driving thin film transistor (hereinafter, referred to as driving TFT) for driving the OLED. Degradation occurs in elements of the OLED and the driving TFT as the driving time passes. Electric characteristic of each element may be sensed during sensing mode operation to compensate for degradation.

The scan driver 13 outputs a scan signal in response to a gate timing control signal GDC supplied from the timing controller 11. The scan driver 13 outputs a scan signal, which includes a scan high voltage and a scan low voltage, through scan lines 15.

The data driver 12 converts a data signal DATA to an analog type data voltage in accordance with a data timing control signal DDC during display mode operation and supplies the analog type data voltage to the display panel 10. The data driver 12 senses characteristic of an element included in at least one of the pixels PXL and feeds the sensed sensing data SD back to the timing controller 11 during sensing mode operation.

The timing controller 11 may operate in a display mode for image display and a sensing mode for sensing electric characteristics of the pixels PXL.

In the display mode, the timing controller 11 is supplied with a driving signal, which includes a data enable signal DE or a vertical synchronization signal, a horizontal synchronization signal and a clock signal, and a data signal DATA for image display from an image processor. The timing controller 11 generates a gate timing control signal GDC for controlling an operation timing of the scan driver 13 and a data timing control signal DDC for controlling an operation timing of the data driver 12 based on the driving signal. The timing controller 11 transmits the data timing control signal DDC and the data signal DATA to the data driver 12, and transmits the gate timing control signal GDC to the scan driver 13.

In the sensing mode, the timing controller 11 transmits a sensing mode signal to the scan driver 13 and the data driver 12 and receives characteristic of an element included in at least one pixel of the pixels PXL as the sensing data SD. The timing controller 11 may correct the data signal DATA to be written in a pixel P based on the sensing data SD fed back from the data driver 12.

Figure 2:
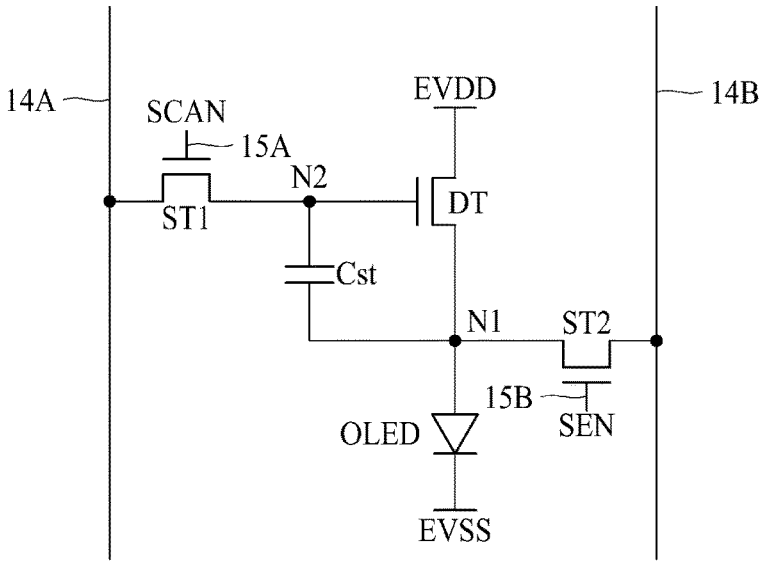
FIG. 2 is an exemplary view illustrating a pixel circuit formed in a display panel of FIG. 1 according to an embodiment of the present disclosure.

FIG. 2 is an exemplary view illustrating a pixel circuit formed in a display panel of FIG. 1 according to anembodiment of the present disclosure.

Referring to FIG. 2, a driving circuit in a pixel may include an OLED, a driving TFT DT, a first switch TFT ST1 for switching, a second switch TFT ST2 for sensing, and one capacitor (storage capacitor Cst).

The OLED has an anode electrode and a cathode electrode. In the OLED, the anode electrode is connected to a base voltage EVSS, and the cathode electrode is connected to a source node or a drain node of the driving TFT DT. Therefore, light emission luminance of the OLED may be controlled in accordance with a size of a driving current input the cathode electrode.

The driving TFT DT supplies a driving current to the OLED in accordance with a potential difference between a gate electrode and a source electrode. The driving TFT DT has a gate electrode, a first electrode and a second electrode. The first electrode may be a drain electrode, and the second electrode may be a source electrode. The first electrode is connected to EVDD, and the second electrode is connected to the first node N1 connected with the anode electrode of the OLED. The gate electrode is connected to a second node N2 connected with the first switch TFT ST1.

The first switch TFT ST1 transfers the data voltage Vdata to the gate node of the driving TFT DT. The first switch TFT ST1 is turned on/off by a scan signal SCAN applied to the gate electrode to electrically connect or disconnect a node N2 and a data line 14A with or from each other.

The storage capacitor Cst is connected between the node N1 and the node N2 of the driving TFT DT. The storage capacitor Cst maintains a voltage between gate and source of the driving TFT DT for one frame time.

A scan line 15B is connected to a gate electrode of the second switch TFT ST2, and the first electrode is connected with the first node N1 and the second electrode is connected with a sensing line 14B. The second switch TFT ST2 connects the first node N1 with the sensing line 14B in accordance with a sensing signal SENSE input to the gate electrode. The second switch TFT ST2 may be turned on by the sensing signal SENSE to supply a reference voltage Vref supplied to the sensing line 14B to the node N1, and may transfer the voltage of the node N1 to the data driver 12 through the sensing line 14B.

In addition to the aforementioned pixel structure of 3T1C, various pixel structures such as 4T1C, 5T1C and 7T1C may be applied to the present disclosure, and the present disclosure is not limited to the aforementioned embodiment.

Figure 3:
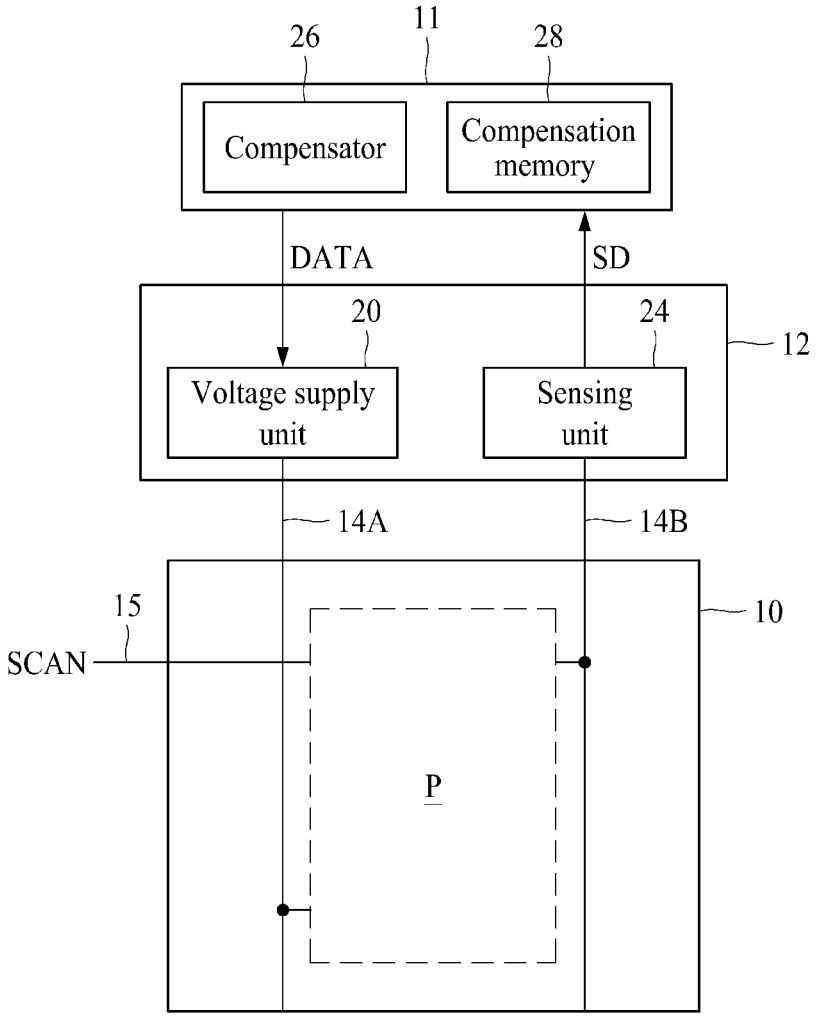
FIG. 3 is a schematic view illustrating an external compensation circuit using a timing controller and a data controller according to an embodiment of the present disclosure.

FIG. 3 is a schematic view illustrating an external compensation circuit using a timing controller and a data controller according to an embodiment of the present disclosure. A circuit for sensing an element included in a pixel may be embodied as a separate sensing circuit not the data driver 12. However, a description will be given based on that the sensing circuit is included in the data driver 12.

Referring to FIG. 3, the timing controller 11 includes a compensation memory 28 for storing sensing data SD for data compensation, and a compensator 26 for compensating for a data signal DATA to be written in the pixel P based on the sensing data SD.

In the sensing mode, the timing controller 11 may control a whole operation for sensing mode driving in accordance with a predefined sensing process.

The compensator 26 corrects the data signal DATA to be written in the pixel P based on the sensing data SD stored in the compensation memory 28 and then outputs the corrected data signal to the data driver 12.

The data driver 12 includes a voltage supply unit 20 outputting the data voltage to be written in the pixel P and a sensing unit 24 sensing characteristic of the element included in the pixel P.

The voltage supply unit 20 may output a display data voltage and a sensing data voltage through a data channel connected to the data line 14A. The voltage supply unit 20 may have a plurality of data channels. The voltage supply unit 20 includes a digital-to-analog converter DAC converting a digital signal to an analog signal, and generates a display data voltage or a sensing data voltage.

The voltage supply unit 20 generates the display data voltage in response to the data timing control signal DDC provided by the timing controller 11 during the display mode. The voltage supply unit 20 supplies the display data voltage to the data line 14A. The display data voltage supplied to the data line 14A is synchronized with a turn-on timing of the display scan signal SCAN and then applied to the pixel P during the display mode.

The voltage supply unit 20 generates a preset sensing data voltage and supplies the generated data voltage to the data line 14A during a sensing mode. The sensing data voltage supplied to the data line 14A is synchronized with a turn-on timing of the sensing scan signal SEN and applied to the pixel P during the sensing mode. The voltage (the voltage between the nodes N1 and N2) between the gate and the source of the driving TFT DT included in the pixel P is programmed by the sensing data voltage.

The sensing unit 24 senses characteristic of the element included in the pixel P through the sensing line 14B connected to the sensing line 14B. The sensing unit 24 may sense the voltage of the first node N1 of the driving TFT DT included in the pixel P. The sensing unit 24 drives the sensing mode under the control of the timing controller 11. The sensing unit 24 senses and samples the signal from the pixel P, converts the sampled result through an analog-to-digital converter (hereinafter, referred to as ADC) and outputs the converted data to the timing controller 11.

The timing controller 11 may control a whole operation for sensing mode driving in accordance with a predefined sensing process. The sensing mode driving may be performed for a vertical blank period in the middle of display driving, a power-on sequence period before display driving starts, or a power-off sequence period after display driving ends. Hereinafter, a sensing mode method according to an embodiment of the present disclosure will be described in detail.

Figure 4:
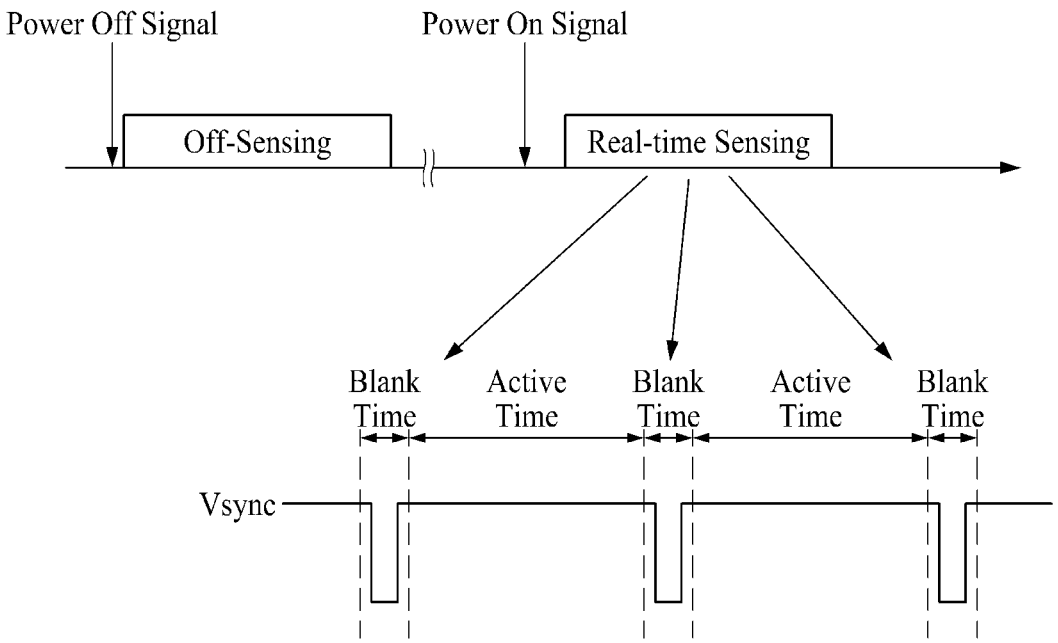
FIG. 4 is a view illustrating a sensing method of an organic light emitting display device according to an embodiment of the present disclosure.
Figure 5:
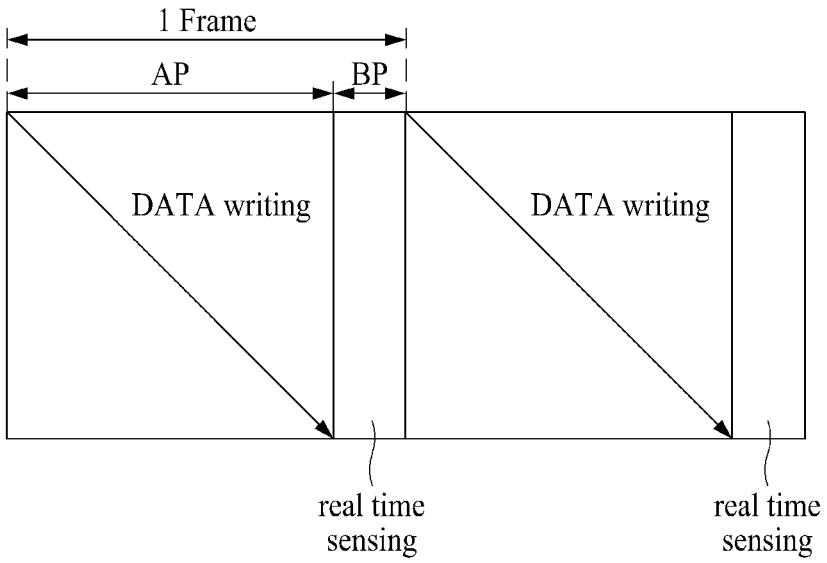
FIG. 5 is a view illustrating a sensing period of a pixel current in one frame of an organic light emitting display device according to an embodiment of the present disclosure.

FIG. 4 is a view illustrating a sensing method of an organic light emitting display device according to an embodiment of the present disclosure, and FIG. 5 is a view illustrating a sensing period of a pixel current in one frame of an organic light emitting display device according to an embodiment of the present disclosure. The organic light emitting display device according to the embodiment of the present disclosure may perform sensing in a first sensing mode during power-off and perform sensing in a second sensing mode during display driving.

Referring to FIG. 4, the organic light emitting display device according to the embodiment of the present disclosure may sense a threshold voltage Vth of the driving TFT DT in a pixel formed in the display panel 10 after a power-off signal is generated in accordance with a user input, etc. In this way, sensing performed after the power-off signal is generated will be referred to as "off-sensing."

Also, the organic light emitting display device according to the embodiment of the present disclosure may sense the threshold voltage Vth of the driving TFT DT in the pixel in the middle of driving the display mode for displaying an image after a power-on signal is generated in accordance with a user input, etc. In this way, sensing performed in the middle of the display mode will be referred to as "real-time sensing." Real-time sensing may be performed per blank period (blank time) between active periods (active time) based on a vertical synchronization signal Vsync. In case of real-time sensing, sensing may be performed per blank period between active periods based on a vertical synchronization signal Vsync.

Referring to FIG. 5, the threshold voltage Vth of the driving TFT DT may be sensed for a vertical blank period BP of one frame. One frame includes a vertical active period AP and a vertical blank period BP, The vertical active period AP may be defined as a period where data DATA for image display are written in pixels, and the vertical blank period BP may be defined as a period where writing of the data DATA is stopped.

In this way, the organic light emitting display device according to the embodiment of the present disclosure may sense the threshold voltage Vth of the driving TFT DT in the off-sensing mode and the real-time sensing mode.

Since a voltage saturation time of the first node N1 of the driving TFT DT is required for sensing of the threshold voltage Vth of the driving TFT DT, sensing of the threshold voltage Vth of the driving TFT DT needs a relatively longer time than the time when another characteristic of mobility is sensed. Therefore, the threshold voltage Vth of the driving TFT DT could be sensed even in case of off-sensing in the related art, whereas the threshold voltage Vth of the driving TFT DT may be sensed even in the real-time sensing mode in the present disclosure. In order to enable sensing of the threshold voltage Vth of the driving TFT DT even in a real-sensing mode, a sensing structure of FIG. 6 is formed in the display panel 10.

Figure 6:
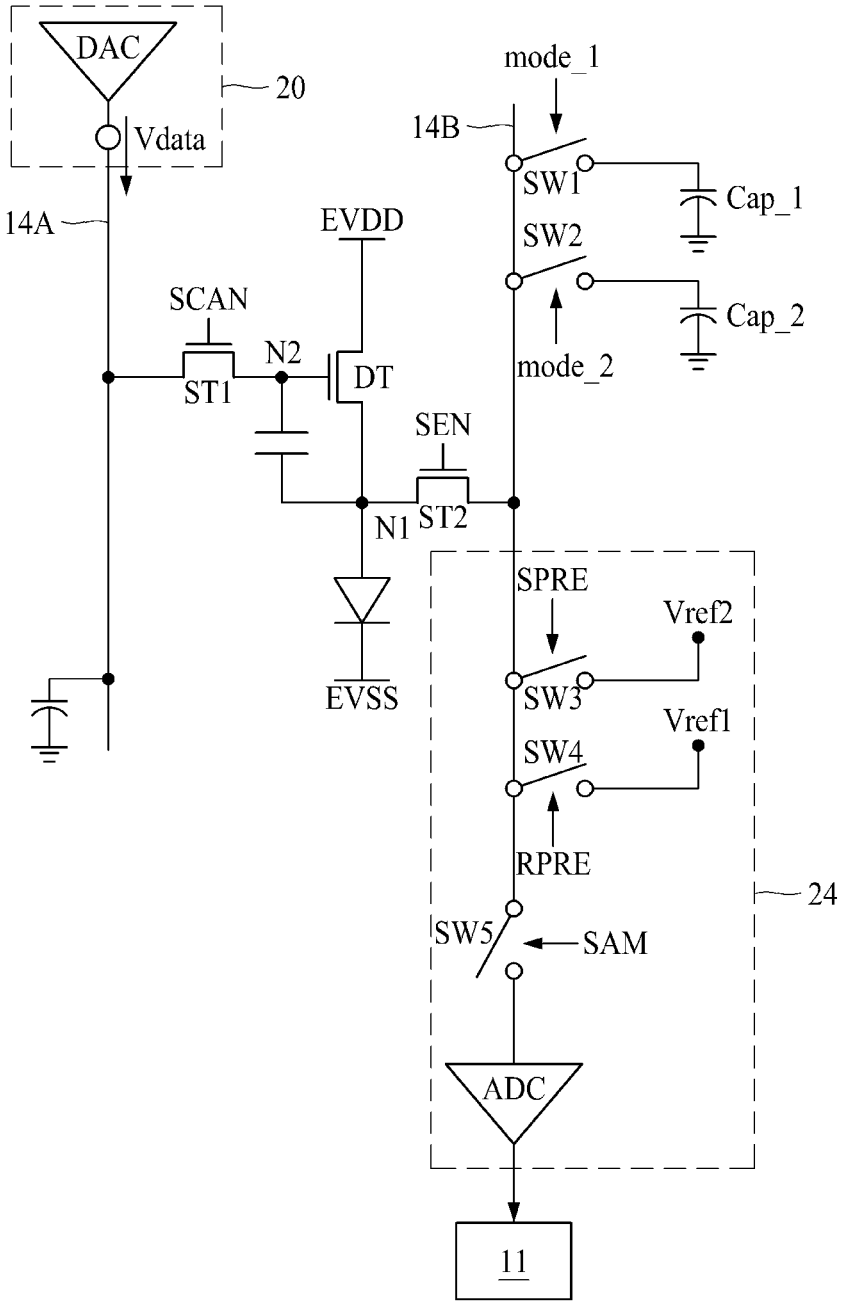
FIG. 6 is an exemplary view illustrating a pixel circuit and a sensing structure of an organic light emitting display device according to an embodiment of the present disclosure.

FIG. 6 is an exemplary view illustrating a pixel circuit and a sensing structure of an organic light emitting display device according to an embodiment of the present disclosure.

Referring to FIG. 6, the pixel circuit includes an OLED, a driving TFT DT, a storage capacitor Cst, a first switch TFT ST1, and a second switch TFT ST2. A data line 14A connected with the first switch TFT ST1 is connected with the voltage supply unit 20 of the data driver 12 (FIG. 3). A sensing line 14B connected with the second switch TFT ST2 is connected with the sensing unit 24 of the data driver 12 (FIG. 3). Since a connection relation and an operation method of the pixel circuit are the same as the pixel circuit FIG. 3, their detailed description will be omitted.

Referring to FIG. 6, the data line 14A is connected to the digital-to-analog converter DAC of the voltage supply unit 20 and supplies the display data voltage or the sensing data voltage. The voltage supply unit 20 generates the display data voltage during a display mode. In the display mode, the first switch TFT ST1 is turned on by a scan signal SCAN to apply the display data voltage supplied to the data line 14A to the second node N2. The voltage supply unit 20 generates a preset sensing data voltage during an off-sensing mode and a real-time sensing mode to supply the generated data voltage to the data line 14A. In the sensing mode, the sensing data voltage supplied to the data line 14A is applied to the second node N2 through the first switch TFT ST1. Therefore, a voltage (a voltage between nodes N1 and N2) between a gate and a source of the driving TFT DT included in the pixel P is programmed by the sensing data voltage.

The sensing line 14B is connected to the sensing unit 24 to transfer the sensing voltage sensed by the pixel to the sensing unit 24. A first switch TFT SW1 turned on in accordance with a first sensing mode selection signal mode_1 of the timing controller 11 to connect a first capacitor Cap_1 to the sensing line 14B and a second switch TFT SW2 turned on in accordance with a second sensing mode selection signal mode_2 to connect a second capacitor Cap_2 to the sensing line 14B. In an example of the following description, a first sensing mode is an off-sensing mode, and a second sensing mode is a real-time sensing mode.

The first capacitor Cap_1 is connected to the sensing line 14B in the off-sensing mode to store the voltage of the first node N1. The second capacitor Cap_2 is connected to the sensing line 14B in the real-time sensing mode to store the voltage of the first node N1. The real-time sensing mode is executed for a blank period between the active periods based on the vertical synchronization signal.

For example, in operation of frame frequency of 120 Hz, a vertical blank period (90 Line time) used for compensation is 0.04 sec. Generally, in the off-sensing mode, the time required to sense 1 Line is 29,239 μs in case of red (R), 37,236 μs in case of white (W), 30,236 μs in case of green (G), and 36,238 μs in case of blue (B). When the first capacitor Cap_1 is applied based on white (W) that requires most time for 1Line sensing, 0.37236 second is required. On the other hand, when the second capacitor Cap_2 having a capacity of 1/12 times of that of the first capacitor is applied, 0.03083 second (0.37236/12) is required. In the real-time sensing mode, the time required for insertion of a black frame is 0.00833 second (1/120). Therefore, the total required time is 0.03083+0.00833=0.03916 second, and is shorter than 0.04 sec which is a Vertical Blank 90Line Time. Capacity of a capacitor is defined as C=cQ/d. If specific resistance of the capacitor is equal to a distance 'd', the smaller the capacity is, the smaller a charge Q stored in a sensing capacitor is. Therefore, since the charge Q of the capacitor used for sensing becomes smaller, saturation time charged for a voltage becomes shorter. As the second capacitor Cap_2 having a capacitor of 1/12 times of that of the first capacitor Cap_1 applied in the off-sensing mode is applied, sensing may be performed for a short time, whereby the voltage of the source node N1 of the driving TFT DT may be stored even in case of the real-time sensing mode.

The sensing unit 24 includes an analog-to-digital converter ADC connected to the sensing line 14B, a fourth switch SW4 controlling electric connection between a first reference voltage source Vref1 and the sensing line 14B, a third switch SW3 controlling electric connection between a second reference voltage source Vref2 and the sensing line 14B, and a fifth switch SW5 controlling electric connection between the analog-to-digital converter ADC and the sensing line 14B.

The fourth switch SW4 may connect the first reference voltage source Vref1 with the sensing line 14B in accordance with a first initialization signal RPRE. The third switch SW3 may connect the second reference voltage source Vref2 with the sensing line 14B in accordance with a second initialization signal SPRE. In this case, the second reference voltage source Vref2 may have a voltage value lower than the first reference voltage source Vref1. The fifth switch SW5 may connect the sensing line 14B with the analog-to-digital converter ADC in accordance with a sampling signal SAM.

The analog-to-digital converter ADC converts a sampling result of sensing data transferred through the sensing line 14B to a digital type and outputs the converted result to the timing controller 11.

Figure 7:
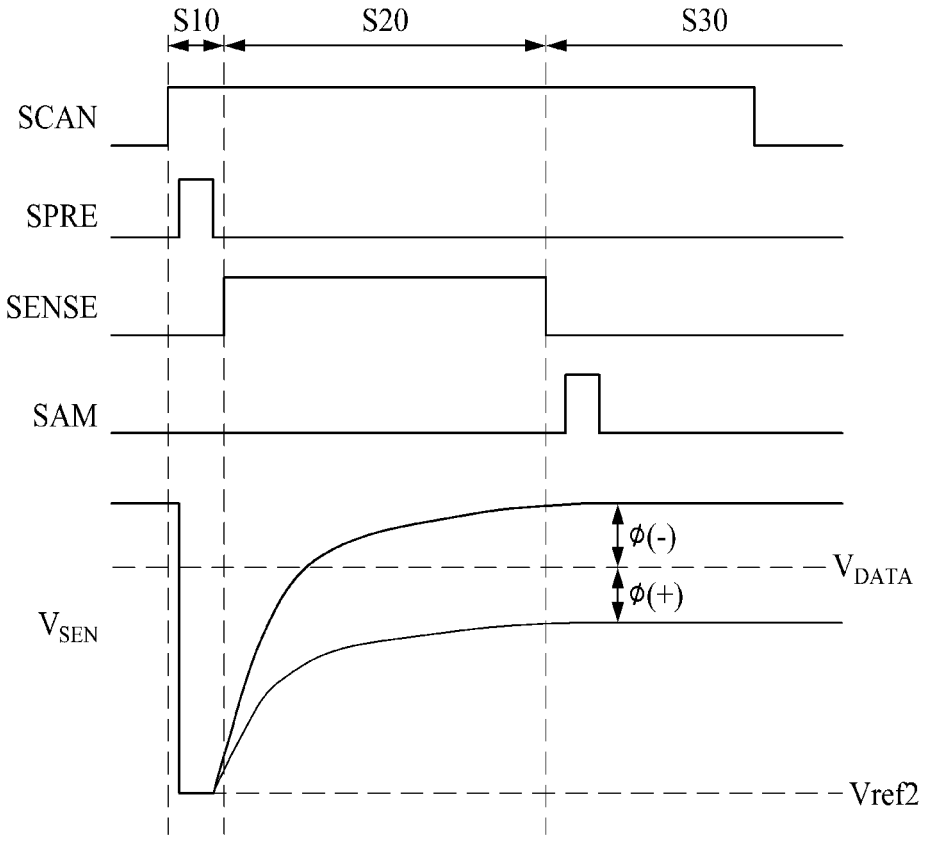
FIG. 7 is a driving timing view illustrating a sensing operation of an organic light emitting display device according to an embodiment of the present disclosure.

FIG. 7 is a driving timing view illustrating a sensing operation of an organic light emitting display device according to an embodiment of the present disclosure.

Referring to FIG. 7, sensing driving of the organic light emitting display device according to an embodiment of the present disclosure may be performed by an initialization step S10, a sensing step S20, and a sampling step S30.

In the initialization step S10, the first switch TFT ST1 is turned on in accordance with a scan signal SCAN of an on-level, and the second switch TFT ST2 is turned off in accordance with a sensing signal SENSE of an off-level. The second reference voltage source Vref2 is connected to the sensing line 14B in accordance with the second initialization signal SPRE so that a potential of the sensing line 14B is initialized to the second reference voltage Vref2.

In the sensing step S20, the first switch TFT ST1 is turned on in accordance with a scan signal SCAN of an on-level, and the second switch TFT ST2 is turned on in accordance with a sensing signal SENSE of an on-level. The sensing data voltage is applied to the gate node N2 of the driving TFT DT and thus a pixel current flows between the drain and the source, whereby a potential of the source node N1 of the driving TFT DT is increased by the pixel current. The sensing line 14B connected to the source node N1 of the driving TFT DT is floated for the sensing period. Therefore, the potential of the sensing line 14B is increased in the same manner as the source node N1, and the potential of the second capacitor Cap_2 connected to the sensing line 14B is also increased.

In the sampling step S30, the second switch TFT ST2 is turned off in accordance with a sensing signal SENSE of an off-level. The fifth switch SW5 connects the sensing line 14B with the analog-to-digital converter ADC in accordance with a sampling signal SAM. Therefore, the potential of the second capacitor Cap_2 connected to the sensing line 14B, that is, the potential of the source node N1 is sampled and thus output as sensing data through the analog-to-digital converter ADC.

Figure 8A:
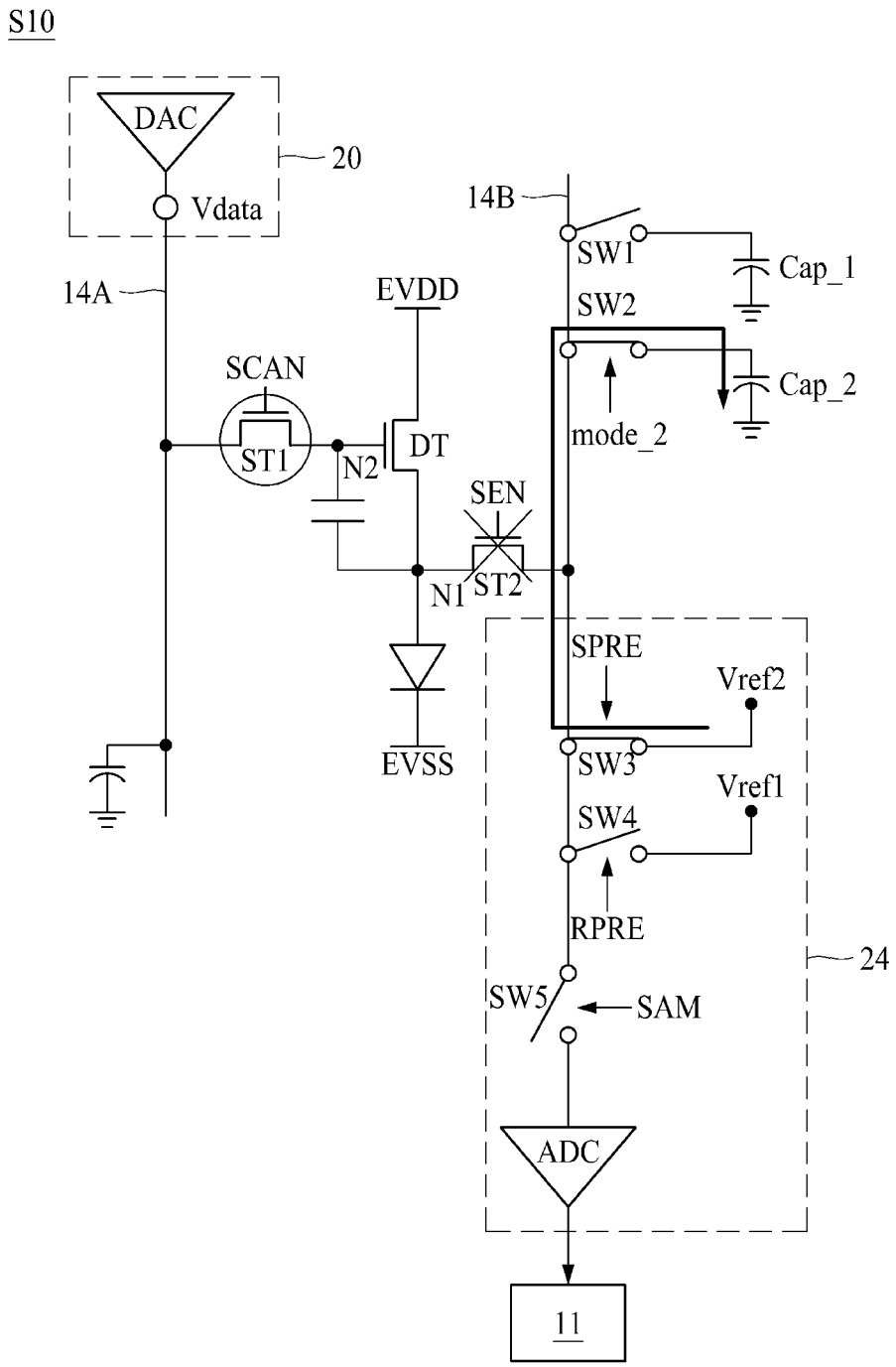
FIGS. 8A to 10B are views illustrating voltage waveforms of a node N1 and a sensing mode operation of an organic light emitting display device according to embodiments of the present disclosure.
Figure 8B:
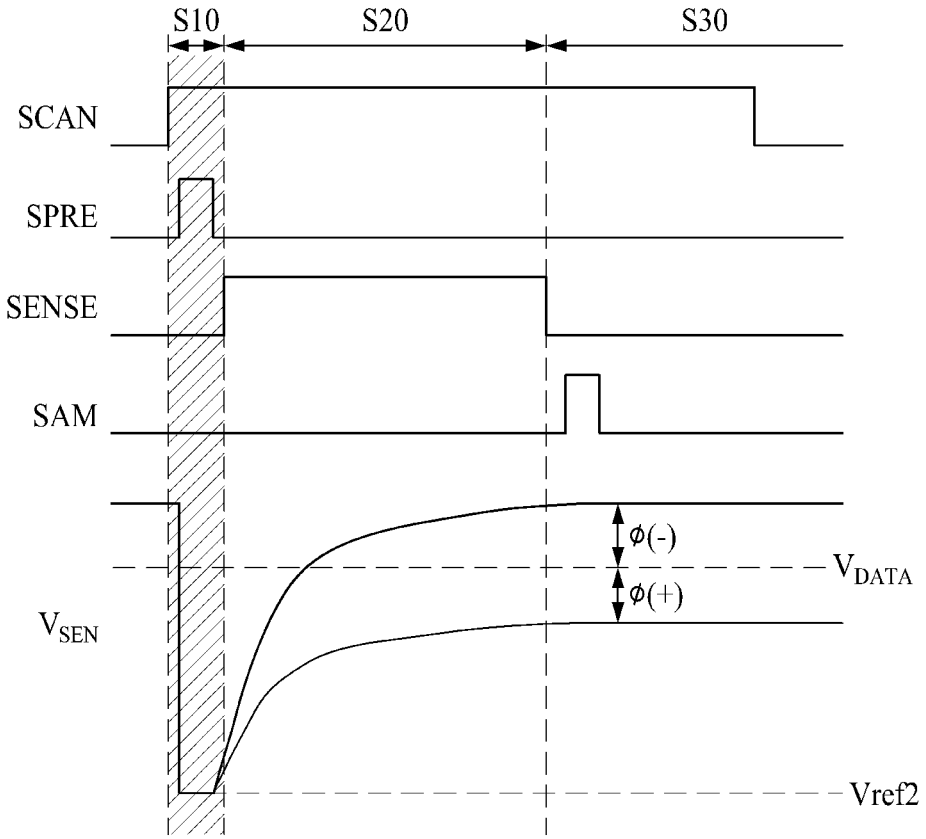
Figure 9A:
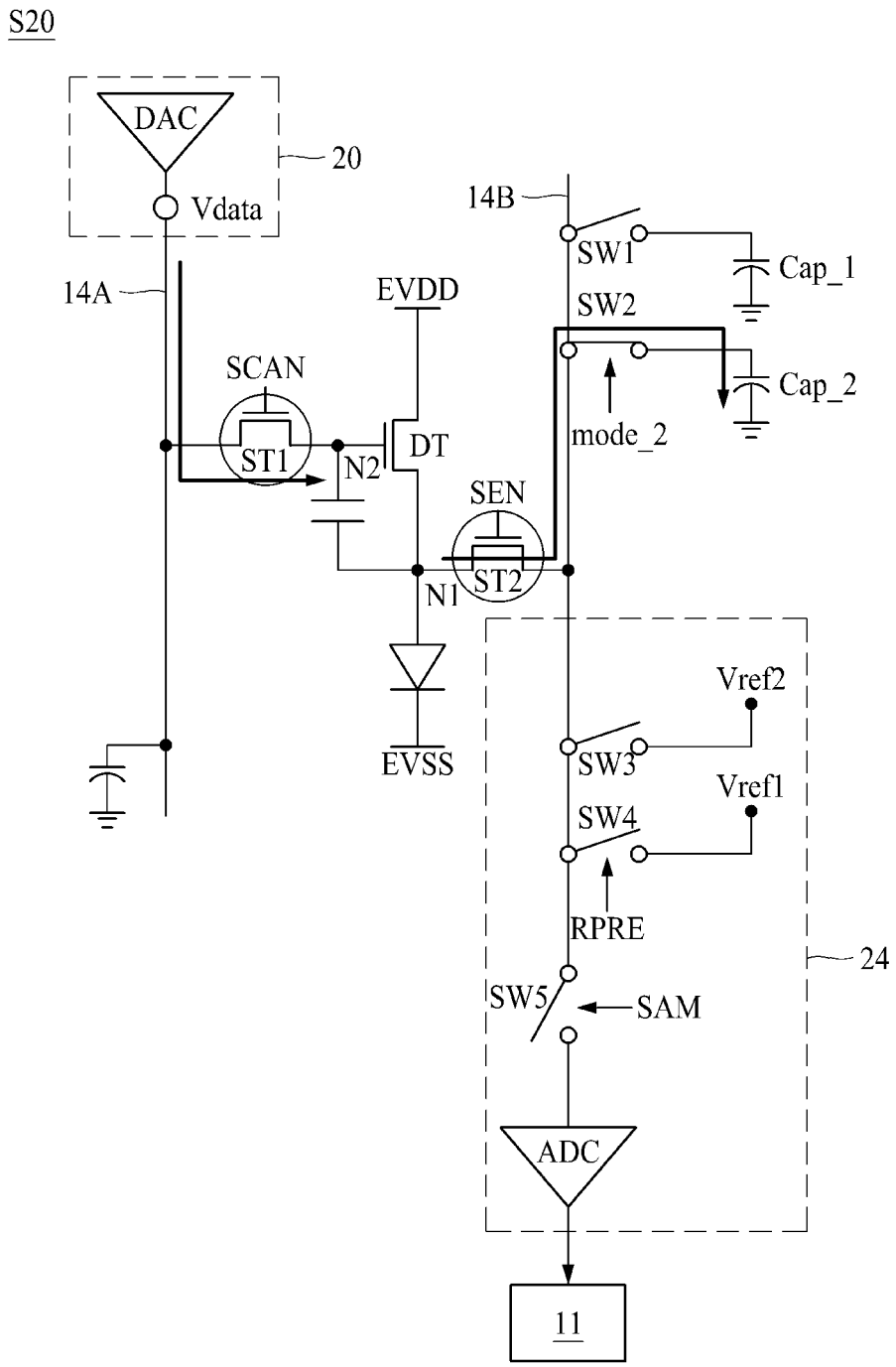
Figure 9B:
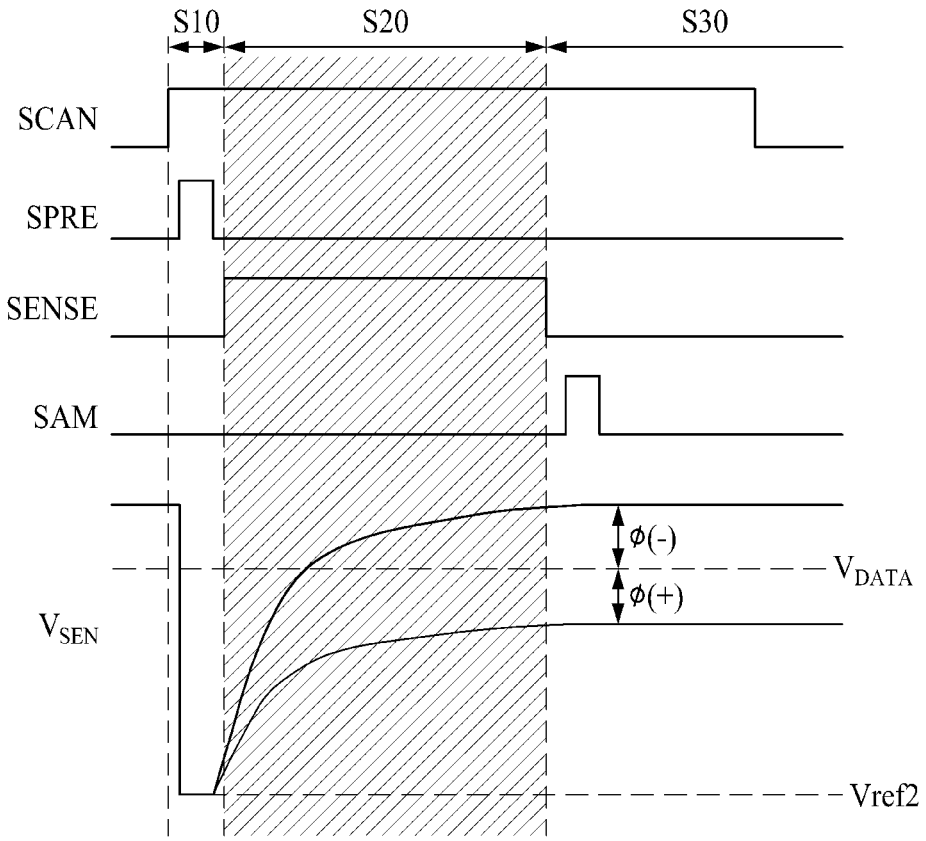
Figure 10A:
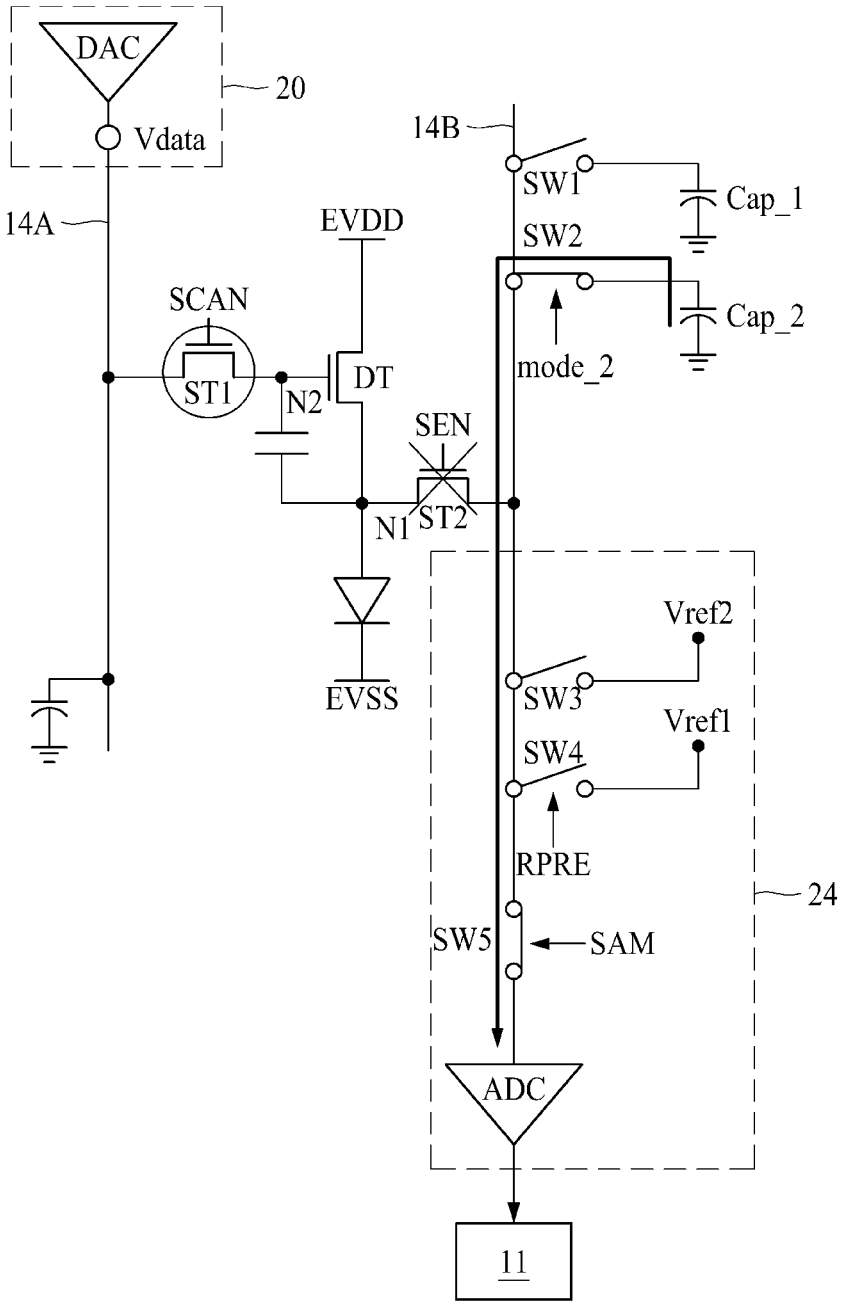
Figure 10B:
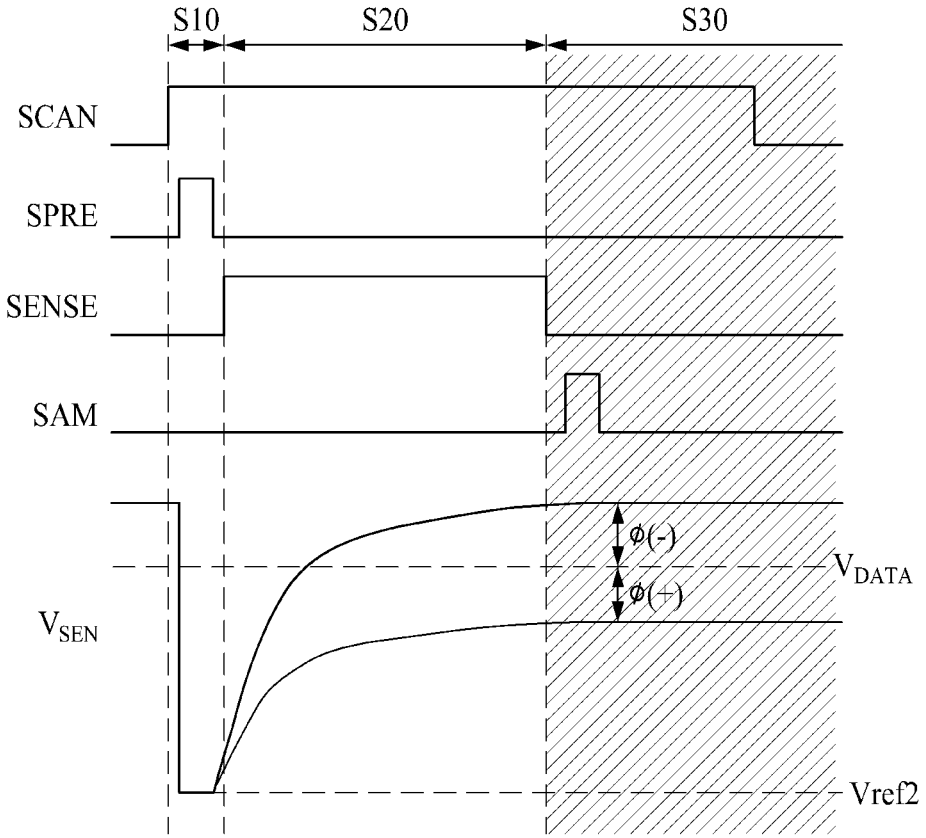

FIGS. 8A to 10B are views illustrating voltage waveforms of a node N1 and a real-time sensing mode operation of an organic light emitting display device according to an embodiment of the present disclosure. FIGS. 8A and 8B illustrate an initialization step S10, FIGS. 9A and 9B illustrate a sensing step S20, and FIGS. 10A and 10B illustrate a sampling step S30. In the real-time sensing mode, the second switch SW2 is turned on in accordance with a second sensing mode selection signal mode_2 of the timing controller 11, whereby the second capacitor Cap_2 is connected to the sensing line 14B.

Referring to FIGS. 8A and 8B, in the initialization step S10, the first switch TFT ST1 is turned on in accordance with a scan signal SCAN of an on-level, and the second switch TFT ST2 is turned off in accordance with a sensing signal SENSE of an off-level. The second reference voltage source Vref2 is connected to the sensing line 14B in accordance with the second initialization signal SPRE so that the potential of the sensing line 14B is initialized to the second reference voltage Vref2. Therefore, the potential of the second capacitor Cap_2 connected to the sensing line 14B is also initialized to the second reference voltage source Vref2.

Referring to FIGS. 9A and 9B, in the sensing step S20, the first switch TFT ST1 is turned on in accordance with a scan signal SCAN of an on-level, and the second switch TFT ST2 is turned on in accordance with a sensing signal SENSE of an on-level.

The sensing data voltage is applied to the gate node N2 of the driving TFT DT and thus a pixel current flows between the drain and the source, whereby a potential of the source node N1 of the driving TFT DT is increased by the pixel current. That is, a source following operation for following the voltage of the gate node (node N2) by the voltage of the source node N1 of the driving TFT DT is performed, and the voltage of the source node N1 of the driving TFT DT is saturated, and then the voltage of the source node N1 of the driving TFT DT is sensed as a sensing voltage Vsense. At this time, a change of the threshold voltage of the driving TFT DT may be identified based on the sensed sensing voltage Vsense. The sensing line 14B connected to the source node N1 of the driving TFT DT is floated for the sensing period. Therefore, the potential of the sensing line 14B is increased in the same manner as the source node N1, and the potential of the second capacitor Cap_2 connected to the sensing line 14B is also increased.

Referring to FIGS. 10A and 10B, in the sampling step S30, the second switch TFT ST2 is turned off in accordance with a sensing signal SENSE of an off-level. The fifth switch SW5 connects the sensing line 14B with the analog-to-digital converter ADC in accordance with a sampling signal SAM. Therefore, the potential of the second capacitor Cap_2 connected to the sensing line 14B, that is, the potential of the source node N1 of the driving TFT DT is sampled and thus output as sensing data through the analog-to-digital converter ADC.

As described above, in the organic light emitting display device and the driving method thereof according to the present disclosure, a small scaled capacitor applicable to the sensing line during real-time sensing may additionally be provided, whereby the threshold voltage of the driving TFT may be sensed even for the blank period between frames. As a result, the threshold voltage of the driving TFT may be sensed in real time and compensated. Also, in the organic light emitting display device and the driving method thereof according to the present disclosure, a driving state is maintained for a long time without power-off, and the threshold voltage of the driving TFT may be sensed to compensate for the changed threshold voltage with respect to the organic light emitting display device in which the same frame is repeatedly scanned, for example, a display device used for an electric sign board or a bulletin board.

It will be apparent to those skilled in the art that the present disclosure described above is not limited by the above-described embodiments and the accompanying drawings and that various substitutions, modifications, and variations can be made in the present disclosure without departing from the spirit or scope of the disclosures. Consequently, the scope of the present disclosure is defined by the accompanying claims, and it is intended that all variations or modifications derived from the meaning, scope, and equivalent concept of the claims fall within the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. An organic light emitting display device comprising:

a display panel provided with pixels connected to a sensing line; and a sensing unit outputting a sensing voltage of the pixel, which is input through the sensing line, as sensing data in a first sensing mode performed during power-off and a second sensing mode performed in middle of driving a display mode, wherein the display panel includes:

a first capacitor connected to the sensing line to store a sensing voltage of the first sensing mode and provide the sensing voltage of the first sensing mode to the sensing unit; and a second capacitor connected to the sensing line to store a sensing voltage of the second sensing mode and provide the sensing voltage of the second sensing mode to the sensing unit.

2. The organic light emitting display device of claim 1, wherein the second capacitor has a capacity smaller than that of the first capacitor.

3. The organic light emitting display device of claim 1, further comprising:

a first switch connecting the first capacitor with the sensing line in accordance with a first sensing mode selection signal; and a second switch connecting the second capacitor with the sensing line in accordance with a second sensing mode selection signal.

4. The organic light emitting display device of claim 1, wherein the sensing unit includes:

a fourth switch connecting the sensing line with a first reference voltage source;

a third switch connecting the sensing line with a second reference voltage source; and a fifth switch connecting the sensing line with an analog-to-digital converter to sample the sensing voltage.

5. The organic light emitting display device of claim 1, further comprising a voltage supply unit supplying data for the first sensing mode to the pixel in the first sensing mode and supplying data for the second sensing mode for a blank period between active periods based on a vertical synchronization signal in the second sensing mode.

6. The organic light emitting display device of claim 5, wherein the voltage supply unit supplies image data for image display for the active period.

7. The organic light emitting display device of claim 1, wherein the pixel includes a driving thin film transistor (TFT) and an organic light emitting diode (OLED) of which amount for light emission is controlled in accordance with the driving TFT, and the sensing voltage is a threshold voltage of the driving TFT.

8. The organic light emitting display device of claim 1, further comprising a timing controller outputting a first sensing mode selection signal during the power-off, outputting a second sensing mode selection signal in the middle of driving the display mode to receive the sensing data from the sensing unit, and compensating for image data displayed in middle of driving the display mode based on the sensing data.

9. The organic light emitting display device of claim 8, wherein the timing controller outputs the second sensing mode selection signal for the blank period between active periods based on a vertical synchronization signal.

10. A driving method of an organic light emitting display device, the driving method comprising:

receiving sensing data of a pixel connected to a sensing line through a first capacitor driven in a first sensing mode during power-off and connected to the sensing line;

supplying image data for image display to the pixel for an active period based on a vertical synchronization signal in middle of driving a display mode; and receiving the sensing data of the pixel connected to the sensing line through a second capacitor driven in a second sensing mode for a blank period between active periods and connected to the sensing line.

11. The driving method of claim 10, wherein the second capacitor has a capacity smaller than that of the first capacitor.

12. The driving method of claim 10, wherein the pixel includes a driving thin film transistor (TFT) and an organic light emitting diode (OLED) of which amount for light emission is controlled in accordance with the driving TFT.

13. The driving method of claim 10, further comprising compensating for the image data based on the sensing data.

* * * * *